US007021427B2

(12) United States Patent
Skovgaard et al.

(10) Patent No.: US 7,021,427 B2
(45) Date of Patent: Apr. 4, 2006

(54) LIFTING APPARATUS AND METHOD

(75) Inventors: Michael Skovgaard, Silkeborg (DK); Frank Rosé, Tranbjerg J (DK)

(73) Assignee: V. Guldmann A/S, Aarhus N (DK)

( * ) Notice: Subject to any disclaimer, the term of this patent is extended or adjusted under 35 U.S.C. 154(b) by 236 days.

(21) Appl. No.: 10/476,311

(22) PCT Filed: Apr. 30, 2002

(86) PCT No.: PCT/DK02/00278

§ 371 (c)(1),
(2), (4) Date: Oct. 29, 2003

(87) PCT Pub. No.: WO02/087720

PCT Pub. Date: Nov. 7, 2002

(65) Prior Publication Data

US 2004/0118639 A1 Jun. 24, 2004

(30) Foreign Application Priority Data

Apr. 30, 2001 (DK) ..... 2001 00672

(51) Int. Cl.
*B66B 5/14* (2006.01)

(52) U.S. Cl. ..... 187/281; 187/293; 187/290; 187/901

(58) Field of Classification Search ..... 187/391–394, 187/276, 281, 286, 289, 293, 295, 296, 297, 187/901, 290; 318/59, 61, 66, 798–715; 5/81.1 R, 83.1, 85.1, 89.1; 254/4 R, 264, 254/266, 273; 414/921; 212/312, 314, 318, 212/320, 322

See application file for complete search history.

(56) References Cited

U.S. PATENT DOCUMENTS 3,841,605 A * 10/1974 Joraku et al. ..... 254/127
3,965,403 A * 6/1976 Okado ..... 318/143
4,554,999 A * 11/1985 Kamaike ..... 187/290

(Continued)

FOREIGN PATENT DOCUMENTS

DE 19717743 10/1998

(Continued)

OTHER PUBLICATIONS

Wichert et al.; *Control of an Intelligent Lift System for Severely Disabled Persons;*IEEE; 1998; 2482-86.

*Primary Examiner*—Jonathan Salata
(74) *Attorney, Agent, or Firm*—James Creighton Wray; Meera P. Narasimhan

(57) ABSTRACT

A method for intelligent control includes an exchange of historical parameters of events for operating a system and operating a hoist where an electric motor, preferably a DC-motor, is used for lifting and lowering a lifting belt. It can take place at different speeds by registering amperage through the motor and to perform a switching between fast and slow speed when a given current level is reached. The change in hoisting/lowering speed is achieved when a control unit changes the voltage supplied by the battery unit to the DC-motor or changes the frequency of power supply to an AC-motor. The method makes it possible to control the system and to optimize the hoisting/lowering speed for the lifting belt depending on the load thereon.

14 Claims, 3 Drawing Sheets

U.S. PATENT DOCUMENTS

| | | | | |
|---|---|---|---|---|
| 4,593,792 | A * | 6/1986 | Yamamoto | 187/286 |
| 4,684,856 | A | 8/1987 | Kahkipuro | |
| 5,077,844 | A | 1/1992 | Twitchell et al. | |
| 5,809,591 | A | 9/1998 | Capaldi et al. | |
| 6,619,434 | B1 * | 9/2003 | Smith et al. | 187/281 |

FOREIGN PATENT DOCUMENTS

| | | |
|---|---|---|
| EP | 0477976 | 1/1992 |
| EP | 1090620 | 4/2001 |
| JP | 10057428 | 3/1998 |

* cited by examiner

LIFTING APPARATUS AND METHOD

This application claims the benefit of Danish Application No. PA 2001 00672 filed Apr. 30, 2001 and PCT/DK02/00278 filed Apr. 30, 2002.

BACKGROUND OF THE INVENTION

The present invention relates to a method for controlling a drive unit for a hoist, preferably a hoist for people, where one or more electric motors are used for operating the hoist at different operational sequences for driving/horizontal transport, hoisting/lift and lower in which connection load on the lifting belt as well as the position of the device in a rail system are registered, that the registrations are stored and used for controlling travelling speed, hoist speed, adjustment of the rails depending on the load and the position, that a communication module with data store is used and that a control module is used. The lifting belt may be a lifting apron or a belt constructed of carrier straps.

The invention, moreover, relates to a hoist, preferably a rail-carried hoist for people, where one or more electric motors are used for operating the device at different operational sequences for driving/horizontal transport, hoisting/lift and lower, which device includes means for registering the load as well as the position of the device in a rail system and a control unit arranged to store these registrations and use these to regulate motors for controlling travelling speed, hoist speed, adjustment of rails depending on the load and the position, said hoist includes a communication module and a control module.

In a particular embodiment, the method according to the invention relates to steps where an electric motor is used for lifting the lifting belt which at different operational sequences for lift and lower can be loaded differently or be unloaded, in which connection the load of a person on the lifting belt is registered, that registrations are stored and used for controlling the hoist speed depending on the load.

In a particular embodiment, the hoist according to the invention relates to a system where an electric motor is used for hoisting the lifting belt which at different operational sequences for lift and lower can be loaded at different degrees or be unloaded.

So far, hoists, preferably of the type that has been used as hoist for people, have been able to operate with a well-defined hoist speed irrespective of whether the lifting belt is loaded with a person sitting therein, or not. Such a construction is inconvenient as the hoist speed (and hereby also the lowering speed) will thus always be relatively low compared to the speed that could be used with an unloaded lifting belt.

It will be possible to establish a hoist or a method for operating it, where the hoisting speed/lowering speed is changed manually by the operator. However, such a manual operation can be inconvenient as the risk of maloperation and /or overloading the hoist arises.

From U.S. Pat. No. 5,809,591 a device of the abovementioned type is known, which is provided with resistance regulation for regulating the motor speed and thereby varying the hoist speed. The device is also provided with a strain gauge for registering load of a person which is made a parameter for deciding the hoist speed via a control circuit, as reference data are stored in the control unit and compared to registered data. Due to the way load is registered, this device cannot be used for intelligent controls where the control unit can be used for different operations.

SUMMARY OF THE INVENTION

It is the object of the present invention to provide a method and a hoist of the type mentioned in the introduction, which makes it possible to establish an intelligent way of operating a system and possible to change the hoist speed and lowering speed of the lifting belt depending on the load, and that this is effected automatically, and which enables intelligent control with the possibility of controlling different operations, including operating with more threshold values for change.

This object is achieved with a method being peculiar in that said communication module is used which is connected with an intelligent control module for exchange of historical event parameters between the data store and the control module, whereby activation of the drive unit is established by transmission of signal from the control module to the drive unit for regulation of the power supply to the drive unit. The transmission of signals from the control module to the drive unit can take place wirelessly or via wire connections.

A particular embodiment is peculiar in that the voltage through the motor is registered and used as an expression of the load of the lifting belt, that registrations are stored at least for a momentary and a succeeding operational sequence and that these registrations are used for change of voltage or frequency.

The hoist according to the invention is peculiar in that said communication module comprises a data store and is communicating with an intelligent control module for exchanging historical parameters of events between the data store and the control module and means for wireless transmission of signal from the control module to the drive unit for regulating the power supply to the drive unit for activating the drive unit.

A particular embodiment, where an electric motor is used for hoisting a lifting belt which at different operational sequences for lift and lower can be loaded differently or be unloaded, is peculiar in that the means for registration are intended to register and store a measurement of the voltage through the motor, and that the control unit is arranged to engage variable voltage or variable frequency to the motor depending on the registered amperage in the momentary operational sequence and possibly a preceding operational sequence in order thereby to control the hoist speed.

Provided that a DC-motor is used, the hoist speed will be controlled by varying the voltage. Provided an AC-motor or a stepping motor is used, the hoist speed will be controlled by varying the frequency. It is preferred to use a DC-motor, as rectifiers and so on will be needed for an AC-motor in order for it to perform the same task as a DC-motor.

As the control unit, which for example includes a microprocessor, registers the current through the motor, it will be possible to perform speed control of the lifting belt's movement such that this speed is changed when the voltage exceeds one or more predetermined threshold values that are used as expression of an associated load on the lifting belt. It will be possible to operate with one or more levels for limit values in order to change between two or more speeds or perform a variable control with a largely unlimited number of levels.

However, the invention will be explained with regard to a control between to speeds for unloaded lifting belt and for loaded lifting belt. In such a situation, the amperage will be selected at a level for example corresponding to a weight limit between 20 and 40 kg load on the lifting belt, preferably approximately 35 kg load.

When the hoist is used in a first operational sequence where the lifting belt is on a mat, amperage will be relatively low. As a result of this, the hoist speed will be fast, for example in a magnitude between 30 and 40 mm/s, preferably 35 mm/s. As the lifting belt is raised, the amperage will be constant if there is no load on the belt.

If there is a person in the lifting belt, it will tighten around the person who is sitting in it. This has the effect that the amperage in the motor is increased. As an immediate reaction to such increased amperage, the motor immediately changes to slow hoist speed that for example could be of the magnitude 15–25 mm/s, preferably 20 mm/s. Thus, there will be no risk that the person is lifted with too high speed and/or risk that the motor is overloaded and thereby destroyed.

When the hoist has ended an operational sequence for lift, it is essential that registration of this situation is stored for a succeeding operational sequence where the lifting belt is lowered. If there were no storing, the lowering would take place with fast speed as no exceeding of the value thresholds occur that can cause switching to slow speed. Thus, the storing or the memory will be maintained until a succeeding operational sequence including a lift. When this situation arises, the motor will be activated again with high voltage or high frequency in order to have a first part of the lift with high speed until a possible load is registered in the shape of an exceeding of the value limit for the current through the motor.

Provided that no load on the lifting belt occurs, the whole operational sequence will take place with fast speed. The succeeding operational sequence where the lifting belt is lowered will also take place with fast speed.

In principle, starting-up an operational sequence for lift will each time reset the control unit and perform a check on the load.

When a DC-motor is used and when voltage regulation is used for controlling the hoist speed, it is possible to work with two batteries connected in series, for example with rated voltage of 12V or 24V. It is possible to use voltage over one battery for slow hoist speed and voltage over the connected batteries for fast hoist speed. This means that the batteries can be utilised effectively as same effect is used at both high voltage and fast speed and at low voltage and slow speed.

It is noticed that a situation, where a person is placed in the belt after this has been lifted, always will be succeeded by a lifting function in order to lift the person off the mat. The storing of the result of a succeeding operational sequence can thus be deleted automatically at the beginning of a lifting sequence.

As an alternative to the above explained control of the hoist speed in two different steps with a slow and a fast speed, it will be possible to perform a variation of the hoist speed depending on the load on the lifting belt. Hereby, it becomes possible to have one or more graduations depending on the load, for example the weight of a person situated in the lifting belt.

It is possible to operate a DC-motor with a battery and to provide a voltage regulator which regulates the voltage to the motor below the rated voltage of the battery. Alternatively, it is possible to provide a battery and to use a booster to boost the battery to a higher voltage for fast speed. With such a construction it is possible to use batteries with a low voltage and at the same time save weight in a battery operated hoist, which is desirable. The booster can be of fixed or variable type.

By regulating the voltage through the use of more or fewer of a number of batteries connected in series for the supply of energy to the DC-motor, two or more discrete hoist speeds/lowering speeds are achieved.

In the following, the invention will be explained in more detail with reference to the enclosed drawing where

DETAILED DESCRIPTION OF THE PREFERRED EMBODIMENTS

In the following, the invention will be explained specifically with reference to an embodiment for a hoist which is arranged for regulating hoist/lowering speed at two levels.

Figure 1:
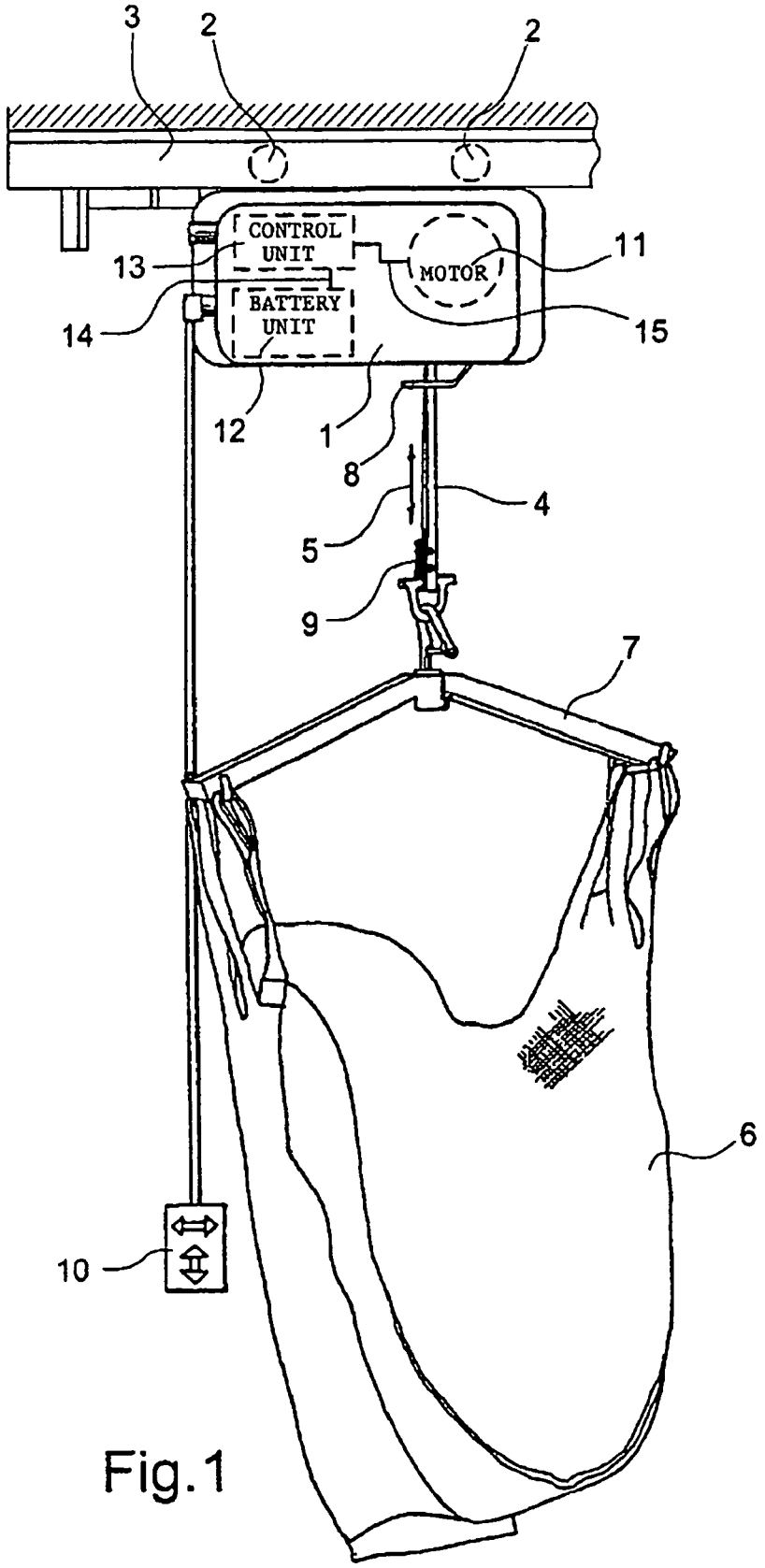
FIG. 1 shows an embodiment of a hoist mounted in ceiling rails for support of a lifting belt.

FIG. 1 shows a hoist 1 which is mounted in a rail system 3 via a wheel 2. A strap 4 is arranged to be able to be led up and down according to the arrow 5, whereby a lifting belt 6 (illustrated without a person) that is suspended in a beam 7 used for lifting and transporting a person. In the shown embodiment, an overload safety device is provided in the shape of a bracket 8 which functions as end stop. The bracket activates a switch in order to stop the motor when a bent down part 9 on the strap 4 engages with the bracket 8. The hoist is operated with a manual operator 10. A DC-motor which is used for lifting and lowering the lifting belt 6 is schematically illustrated by 11. The motor 11 is supplied with energy from a schematically indicated battery box 12. The hoist 1 moreover includes a control unit which is schematically illustrated by 13 and which is connected with the battery 12 and the motor 11 as schematically illustrated by the wires 14, 15 respectively.

Figure 2:
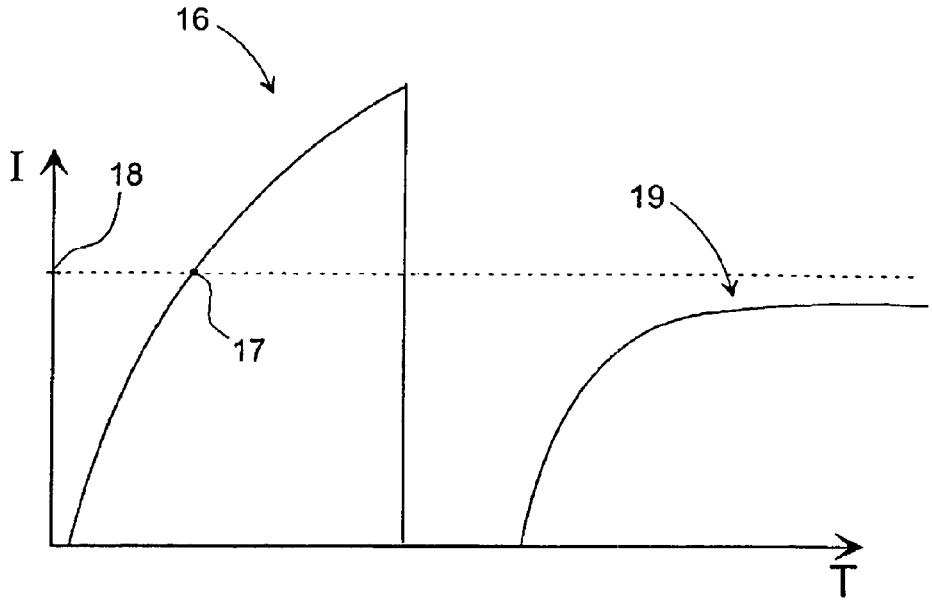
FIG. 2 illustrates an automatic electric circuit diagram in two different operational situations according to the invention.

FIG. 2 illustrates a voltage diagram where the first curve 16 illustrates a situation in which a person is placed in the lifting belt 6. On the first part of the curve, a tightening of the belt will take place up to the point which is indicated by 17. 17 indicates the level 18 for the amperage that is acceptable at a load below a certain load, for example 35 kg. Thus, in point 17 a switching takes place such that the subsequent hoist speed will be slow.

FIG. 2 illustrates a further curve 19. This curve illustrates the lifting speed with an empty lifting belt 6, and it appears that this belt will never reach amperage of the level 18. Therefore, the lifting speed will still take place with the highest lifting speed.

Figure 3:
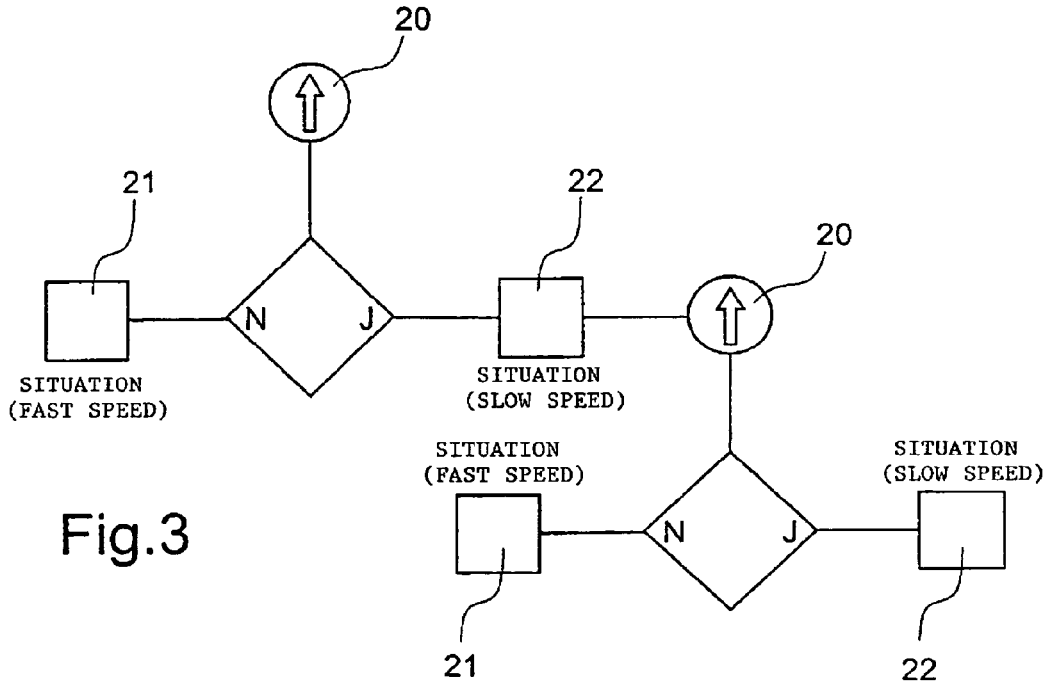
FIG. 3 illustrates a block diagram illustrating operational sequences by using a hoist according to the invention.

In FIG. 3 a diagram is illustrated where a contact 20 on the manual operator is activated in order to start a lift. Hereafter, the control programme will always ask whether the amperage is over or under the threshold value. As long as the answer is "no", a situation 21 with a fast hoist speed will arise. Provided that the answer is "Yes", it is indicated that there is a load on the lifting belt and the situation 22 takes place with slow speed. The switching may occur for example in that the control unit 13 switches the power supply to the motor 11 between a 48V battery and a 24V battery which are provided in the battery supply 12.

The situation 22 will be stored in the memory of the control unit until sometime after the activation of the up contact 20 the answer is "no" again. Then the situation 21 will re-enter and only at this time a change in the lifting speed to fast speed will occur. Provided that at a renewed activation of the contact 20 results in the answer being "yes" to the fact that the electricity level 18 is exceeded, the situation 22 will occur again.

Figure 4:
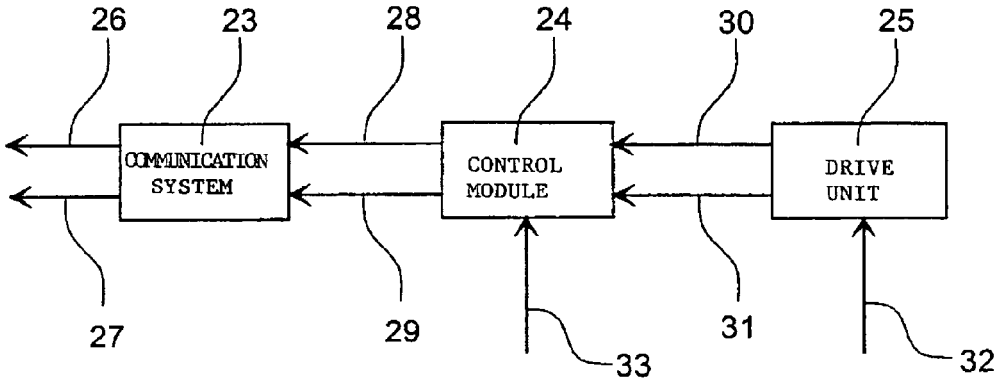
FIG. 4 illustrates a system with a hoist according to the invention with a number of components and the inputs/outputs existing between the different elements of the system.

In FIG. 4 a system is illustrated including a communication system 23 with data store, an intelligent control module 24, and a drive unit 25. The drive unit 25 can consist of one or more motors for vertical lift (which is illustrated by the motor 11 in FIG. 1) or for horizontal transport/driving on a rail system, for example as illustrated by the rail 3 FIG. 1. The rail system can include points that are not illustrated in the figure. The components forming part of the system which is illustrated in FIG. 4, has a number of inputs/outputs that are illustrated by arrows directed against or away from a component in order to illustrate whether it is an input or an output for the component in question. The system includes the following inputs/outputs:

26 report of historical data depending on configuration,

27 configuration inputs for reporting or setting up control module/communication module 23,

28 historical event parameters for the communication module 23,

29 historical event parameters from the data store in the communication module 23,

30 regulated power for the drive unit 25,

31 communication signal with data for momentary current parameters,

32 power for the drive unit 25,

33 communication signal to the communication module 23 for activating the system, for example established with manual switch, voice input, wireless signal or the like.

A system including a hoist and a method according to the invention can be used for controlling hoist speed, controlling driving speed, communication with system components, establishing predefined patterns of movement for the drive unit/lifting belt's hoisting and establishing report to external users when storing signals/data that are stated as inputs/outputs between different components.

The system according to the invention can for example be started by using a manual contact corresponding to the manual switch 10 shown in FIG. 1. Hereby, input 24 is established. A measurement of the motor current and the stored data (inputs 29, 32) are established. Hereby, it can be ascertained whether the lifting belt is loaded or not. If there is no load, a first hoist speed for the hoist motor is selected, and if the lifting belt is loaded a second hoist speed (represented by output 30) is selected. The sequence of events is sent to the communication module (output 28) for later use.

Analogously to the description above, the system can be used with a motor for travelling which receives signals and is regulated analogously corresponding to the hoist motor.

When the system is used, the hoist can be activated by input 33 when the hoist moves closer to a system component, for example points in the rail arrangement. The system component hereby sends out a communication signal which is picked up by the intelligent control module (input 31) of the hoist. Hereby, the hoist can send out a switch signal (represented by output 31) such that the hoist can move around without hindrance, even in a complicated rail system. Typically, the communication signals have a limited range determined by the system's topography, and the communication signals can be made from different types, for example infra-red signal, radio signal, sound signal, light signals, electric signals etc.

Thus, it is possible to activate the hoist by means of a sound signal, represented by input 33, whereby the hoist is running a route simultaneously with the data being stored in the communication module. This sequence of events can thus be replayed by recalling the historical sequence of events. Thus, it is possible activate and operate the hoist only based on historical data in the data store.

By utilising the possibility of a hoist being able to store historical data events, represented by output 28, these can be formatted according to the user's wishes, which are represented by input 27. This can for example be used in a system including a service-log or an application-log and also including a log concerning overload data etc.

The invention is not limited to the embodiments shown above. In the light of the succeeding claims it will for example be possible to have a variable lift/lowering speed or a lift/lowering speed that can be varied at different levels.

In addition, it will be possible that the battery unit 12 includes a booster which can be an alternative to the use of two or more batteries connected in parallel in order to provide the different levels of voltage in order to establish different discrete lifting/lowering speeds for a DC-motor.

The invention claimed is:

1. Method for controlling a drive unit for a hoist, preferably a hoist for people where one or more electric motors are used for operating a hoist at different operational sequences for driving/horizontal transport, hoisting/lift and lower in which connection the load on the lifting belt and the position of the device in a rail system are registered, that the registrations are stored and used for controlling travelling speed, hoist speed, adjustment of the rails depending on the load and the position, that a communication module with data store is used and that a control module is used, characterized in that said communication module is connected with an intelligent control module for exchanging historical parameters of events between the data store and the control module whereby activity of the drive unit is established by transmission of signal from the control module to the drive unit for regulating the power supply to the drive unit.

2. Method according to claim 1, characterized in that the drive unit establishes predefined patterns of movement for driving and hoisting and that historical parameters of events are sent to the communication module for registering and storing in the data store.

3. Method according to claim 1 or 2 where an electric motor is used for lifting the lifting belt which at different operational sequences for lift and lower may be loaded differently or be unloaded, in which connection the weight of a person in the lifting belt is registered, that registrations are stored and used for controlling the hoist speed depending on the load, characterized in that the current through the motor is registered and used as an expression for the load of the lifting belt, that registrations are stored at least for a momentary and a succeeding operational sequence and that these registrations are used for change of voltage or frequency.

4. Method according to claim 1, 2 or 3, characterized in that the hoist speed is controlled at two levels depending on whether the lifting belt is loaded or unloaded.

5. Method according to any of the preceding claims, characterized in that the hoist speed is controlled variably depending on the load of the lifting belt.

6. Method according to any of the preceding claims, characterized in that the motor is a DC-motor powered by a battery.

7. Method according to claim 6, characterized in that the voltage is regulated using a booster.

8. Method according to claim 6, characterized in that at least two series connected batteries are used and that the voltage is regulated by using more or fewer batteries for powering the motor.

9. Hoist, preferably a hoist for people carried by rails, where one or more electric motors are used for operating the device at different operational sequences for driving/horizontal transport, hoisting/lift or lower, which device includes means for registration of the load and the position of the device in a rail system and a control unit arranged for storing these registrations and using these to regulate motors for controlling travelling speed, hoisting speed, adjustment of rails depending on the load and the position, said hoist includes a communication module and a control module, characterized in that said communication module comprises a data store and is communicating with an intelligent control module for exchanging historical parameters of events between the data store and the control module and means for wireless transmission of signal from the control module to the drive unit for regulating the power supply to the drive unit for activating the drive unit.

10. Hoist according to claim 9, characterized in that the data store includes predefined patterns of movement for driving and hoisting, and that the drive unit includes means that are arranged for transmitting historical event parameters to the communication module for registering and storing in the data store.

11. Hoist according to claim 9 or 10 where an electric motor is used for hoisting a lifting belt which at different operational sequences for lift and lower can be loaded differently or be unloaded, characterized in that the means for registration are intended for registering and storing a measurement of the current through the motor, and that the control unit is adapted for connecting variable voltage or variable frequency to the motor depending on the registered amperage in the momentary operational sequence and possibly a preceding operational sequence in order thereby to control the hoist speed.

12. Hoist according to claim 9, 10, or 11, characterized in that the motor is a DC-motor powered by two or more batteries connected in series and that the voltage is regulated by engaging more or fewer batteries.

13. Hoist according to claim 9, 10, or 11, characterized in that the motor is a DC-motor powered by a battery and that a booster is provided for regulating the voltage.

14. Hoist according to the claims 11 and 13, characterized in that it includes a variable voltage regulation.

* * * * *